United States Patent [19]

Chang

[11] Patent Number: 4,953,268

[45] Date of Patent: Sep. 4, 1990

[54] SAFETY DRESS FASTENER

[76] Inventor: C. C. Chang, 1F. No. 19, Alley 52, Lane 245, Sec. 4, Ba-Deh Rd., Taipei, Taiwan

[21] Appl. No.: 463,211

[22] Filed: Jan. 10, 1990

[51] Int. Cl.[5] ..... A44B 1/18

[52] U.S. Cl. ..... 24/694; 24/105

[58] Field of Search ..... 24/694, 617, 101 B, 24/105, 111, 689, 690, 698

[56] References Cited

U.S. PATENT DOCUMENTS

| | | | |
|---|---|---|---|
| 710,671 | 10/1902 | Daily | 24/698 |
| 1,257,026 | 2/1918 | Rundus | 24/690 |
| 1,480,839 | 1/1924 | Robinson | 24/105 |
| 2,085,486 | 6/1937 | Villani | 24/694 |
| 3,248,768 | 5/1966 | Silver | 24/689 |
| 4,521,943 | 6/1985 | Kanzaka | 24/101 B |

FOREIGN PATENT DOCUMENTS

| | | | |
|---|---|---|---|
| 0691596 | 5/1953 | United Kingdom | 24/689 |

*Primary Examiner*—Victor N. Sakran

*Attorney, Agent, or Firm*—Lowe, Price, LeBlanc, Becker & Shur

[57] ABSTRACT

A dress fastener for fastening any two parts of a dress together, which includes a male member comprising a decorative button and a hook portion, and a female member comprising a retaining plate having two unitary screws respectively screwed up with two safety nuts. The male and female members are respectively secured to a dress at two opposite or corresponding parts thereof so that such two parts can be firmly secured together when the hook portion is connected to the retaining plate.

1 Claim, 3 Drawing Sheets

SAFETY DRESS FASTENER

BACKGROUND OF THE INVENTION:

The present invention is related to a safety dress fastener for fastening any two parts of a cloth together, which includes a male member releasably connected with a female member through hook joint.

Regular dress buttons, for example, shirt buttons, jacket buttons, coat buttons, snap fasteners, toggle buttons, ..... etc., they are generally comprises of a male element and a female element respectively secured to two opposite or corresponding parts of a dress so that such two parts of the dress can be firmly secured together when both elements are connected together. Drawbacks of these conventional dress buttons are outlined as hereinafter.

1. Because the male and female elements of a dress button are respectively sewed on two parts of a dress by a sewing silk, if the sewing silk is broken, the two parts of the dress will be unable to secure together.

2. It is difficult to replace a dress button with a new one because the male and female elements of a dress button are permanently sewed o two parts of a dress.

3. The conventional dress buttons are not adjustable. In case one eats too much and wishes to loosen one's dress, one can only unfasten the buttons on one's dress.

4. Replacement of the female element of a button is confined to the size of the corresponding button hole.

The present invention is to provide such a dress fastener which can solve the foregoing problems and provide the following advantages:

1. The female member of a dress fastener of the present invention comprises a decorative button which is designed in a variety of sizes, styles and figures for choice.

2. It is easy to secure to a dress.

3. Its position on a dress can be conveniently abjusted when required.

4. Through screwing, a dress fastener of the present invention can be firmly and efficiently secured to a dress.

5. In addition to the function in fastening two parts of a dress together, the present invention simultaneously serves as an ornament to make a dress more attractive.

6. It provides maximum safety and does not cause any contamination to the dress whom it is secured.

7. No sewing process is required in securing the present invention to a dress.

Figure 1:
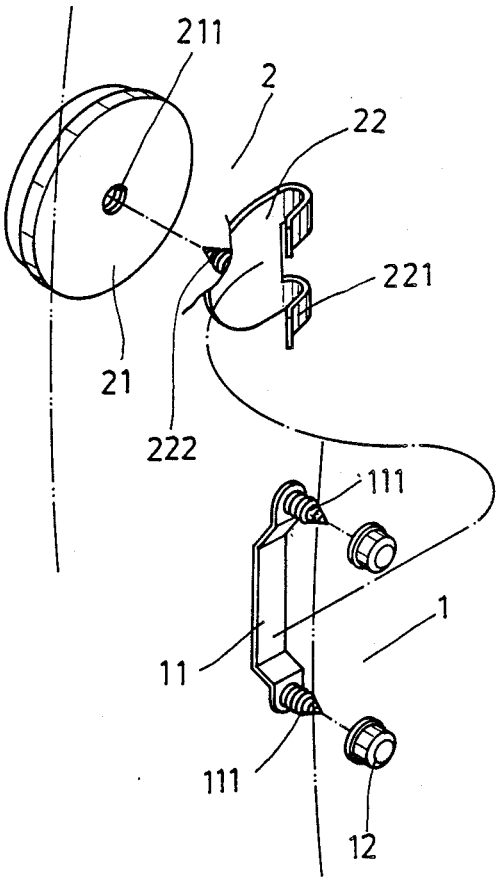
FIG. 1 is a perspective exploded view of a dress fastener according to the present invention.
Figure 2:
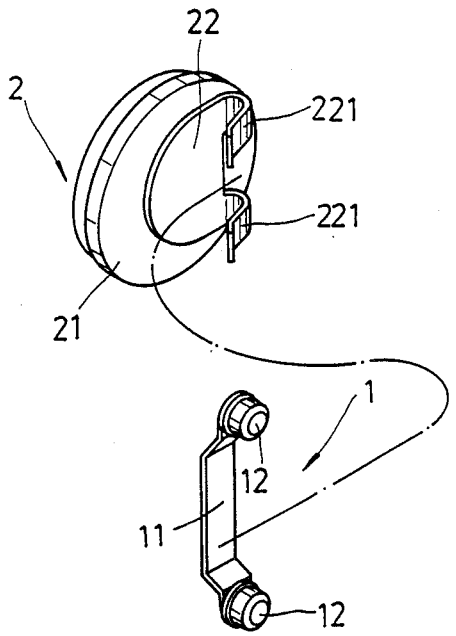
FIG. 2 is a perspective assembly view of the male member and the female member of the dress fastener of FIG. 1.
Figure 3:
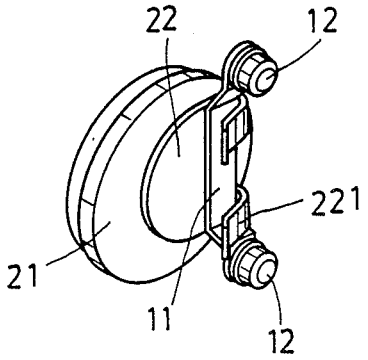
FIG. 3 is a perspective view of the dress fastener of FIG. 1, in which the male member and the female member are inter-connected.
Figure 4:
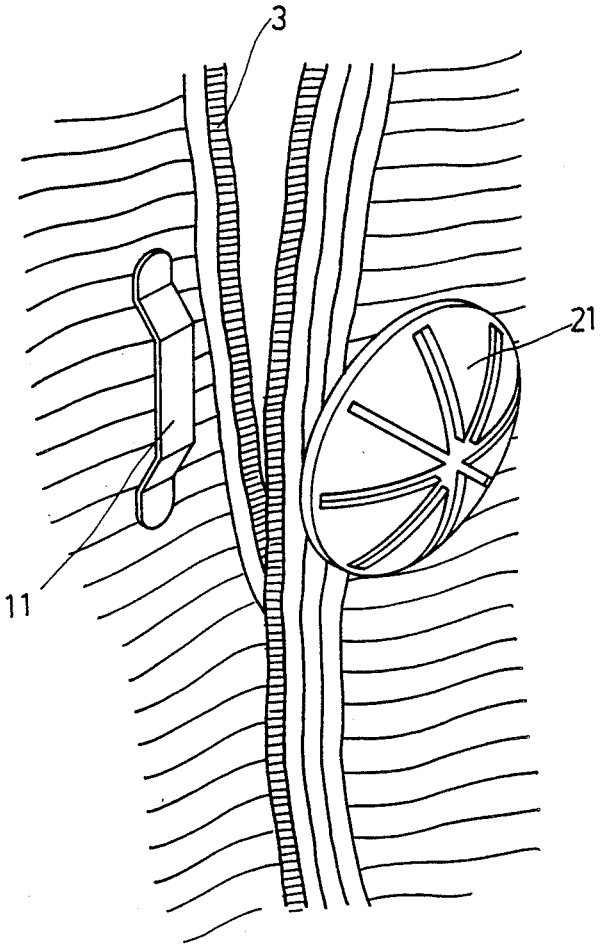
FIG. 4 illustrates the application of the present invention on a dress.

DETAILED DESCRIPTION OF THE PREFERRED EMBODIMENTS:

Turning now to the annexed drawings in greater detail, therein illustrated is a dress fastener embodying the present invention and generally comprised of a male member (1) and a female member (2).

As illustrated, the male member (1) is comprised of a retaining plate (11) having two unitary screws (111) upstanding from its both ends for penetrating through the fabric of a dress (3), and two safety nuts (12) for screwing up with the two screws (111) to secure the male member (1) to such a dress (3).

The female member (2) is comprised of a decorative button (21) having a center bolt hole (211), and a hook element (22) which includes a hook portion (221) and a screw portion (222). The screw portion (222) penetrates the fabric of the dress (3) and screws in the center bolt hole (211) of the decorative button (21) so that the whole assembly of the female member (2) can be secured to the dress (3) at a position corresponding to the male member (1).

As soon as the male member (1) and the female member (2) are respectively secured to the dress (3), the hook portion (221) of the hook element (22) can be hooked up with the retaining plate (11) to fasten up the dress.

According to the present invention, the decorative button (21) of the female member (2) can be in any size and design to match with the dress to fasten.

As is apparent from the foregoing specification, the present invention is susceptible of being embodied with various alterations and modifications which may differ particularly from those that have been described in the foregoing specification and description. It should be understood that we wish to embody within the scope of the patent warranted hereon all such modifications as reasonably and properly come within the scope of our contribution to the art.

I claim:

1. A safety dress fastener, including:

a male member comprised of a retaining plate having two unitary screws upstanding from its both ends, and two safety nuts screwed up with said two screws to secure to a dress; and a female member comprised of a decorative button having a center bolt hole, and a hook element, said hook element comprising a hook portion and a screw portion, said screw portion being screwed in said center bolt hole of said decorative button and secured to said dress at a position corresponding to said male member so that said hook portion can hook on said retaining plate to fasten up said dress.

* * * * *